United States Patent [19]

Gora et al.

[11] Patent Number: 4,892,221

[45] Date of Patent: Jan. 9, 1990

[54] DETACHABLE LID CONTAINER

[75] Inventors: Paul R. Gora, Hartland; Edward M. Kaucic, Watertown, both of Wis.

[73] Assignee: Menasha Corporation, Neenah, Wis.

[21] Appl. No.: 280,777

[22] Filed: Dec. 6, 1988

[51] Int. Cl.[4] ..... B65D 43/14

[52] U.S. Cl. ..... 220/343; 220/342; 292/DIG. 11

[58] Field of Search ..... 220/334, 337, 340, 342, 220/343; 292/DIG. 9, DIG. 11, DIG. 17

[56] References Cited

U.S. PATENT DOCUMENTS

| | | | |
|---|---|---|---|
| 1,676,621 | 7/1928 | Pittelkow | 220/343 |
| 3,933,381 | 1/1976 | Schurman | 292/57 |
| 3,979,016 | 9/1976 | Frater | 220/315 |
| 4,119,195 | 10/1978 | Widener | 220/343 X |
| 4,161,261 | 7/1979 | Frater | 220/337 |
| 4,391,386 | 7/1983 | Moret | 220/343 |
| 4,432,467 | 2/1984 | Swingley, Jr. | 220/334 |
| 4,663,803 | 5/1987 | Gora | 16/266 |
| 4,685,567 | 8/1987 | Webb | 206/506 |

FOREIGN PATENT DOCUMENTS

| | | |
|---|---|---|
| 2208953 | 8/1973 | Fed. Rep. of Germany . |
| 2737237 | 3/1979 | Fed. Rep. of Germany . |

*Primary Examiner*—Stephen Marcus
*Assistant Examiner*—Nora S. Tucker
*Attorney, Agent, or Firm*—Quarles & Brady

[57] ABSTRACT

A detachable two-part lid for a container wherein oppositely positioned wire members hold the two parts of the lid together when separated from the container and also provide a captured hinging of the lid parts when they are positioned on the container. In a preferred manner, a slot is provided in a guide and a gooseneck portion is provided in the wire members, so as to afford a wire rentention feature when the gooseneck portion is moved outwardly from the slot.

12 Claims, 4 Drawing Sheets

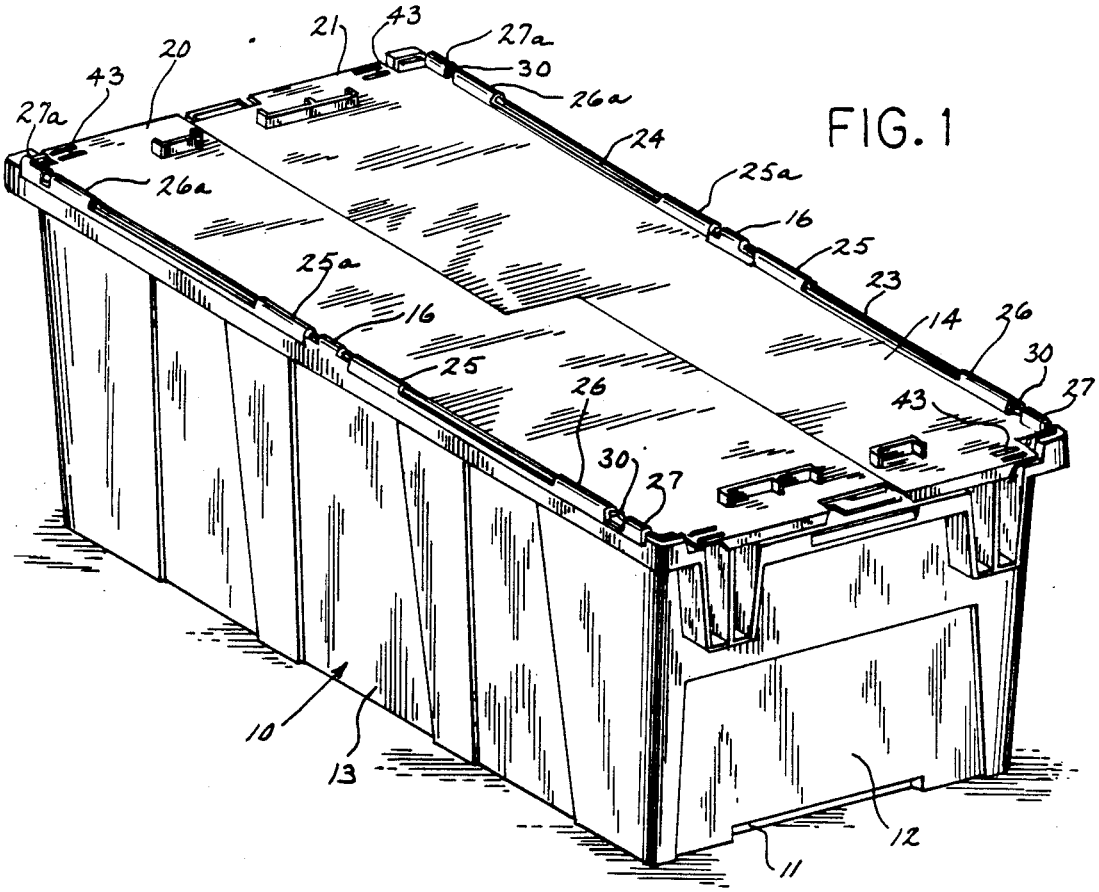
FIG. 1
FIG. 3
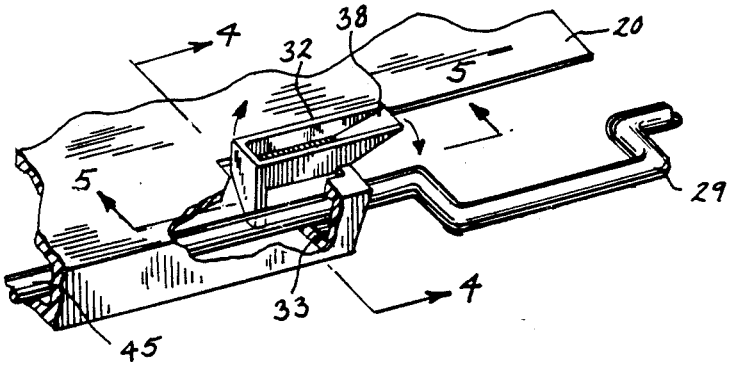
FIG. 5
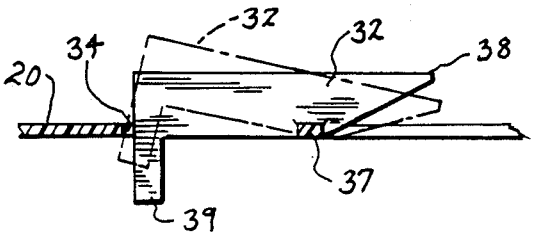
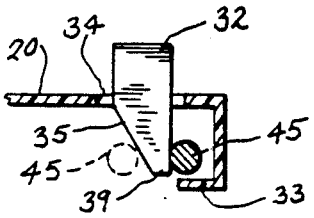
FIG. 4

FIG. 6
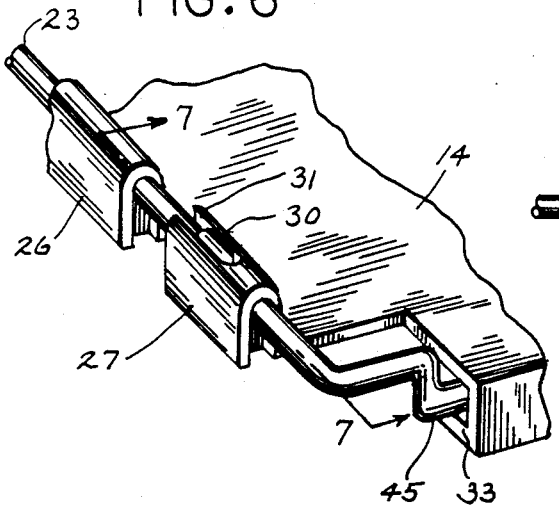
FIG. 7
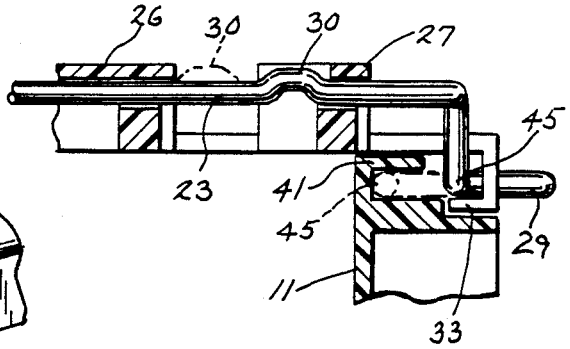
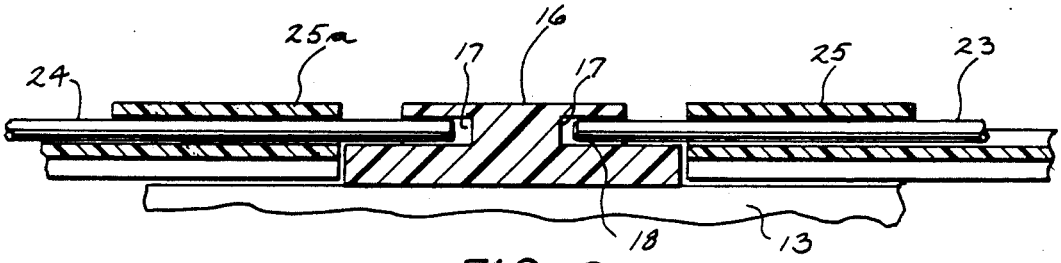
FIG. 8
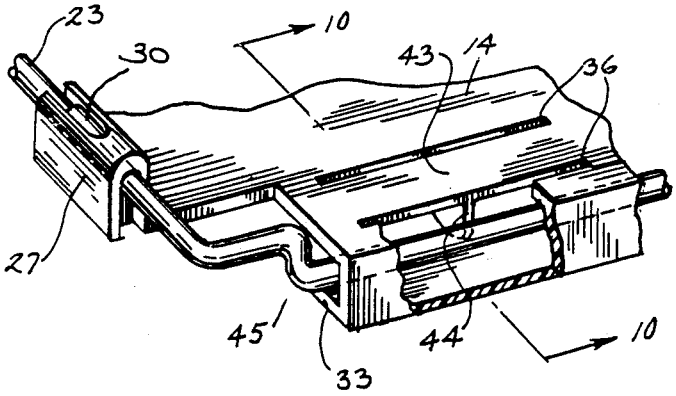
FIG. 9
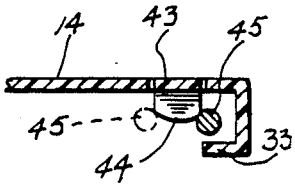
FIG. 10

DETACHABLE LID CONTAINER

BACKGROUND OF THE INVENTION

This invention relates to containers having hinged lids wherein the hinging action is afforded by a hinge wire. More particularly, the invention relates to container lids of the foregoing type wherein the cover is of a two component construction and the lid can be separated from the container as a single unit.

There is a need for a container wherein the cover can be easily connected as well as readily removed and separately stored. This provides a convenient means for nesting the containers whether for storage or returning to the shipper. In many instances when utilizing containers it is desirable to be able to disengage the cover of the container as permanent attachment can cause nesting problems with the lids especially when they are of a large size. The use of a disconnectable hinge arrangement for a container cover is known as indicated in U.S. Pat. No. 3,933,381, which shows a wire bolt means 26 that slides in a trough-shaped groove in the cover. The use of wires as hinge pins for removal of a two-part cover is also indicated in U.S. Pat. No. 4,663,803 and is commonly assigned.

There is not currently known in the prior art, or available, a two-part cover for a container wherein a cover can be removed from the container as a single unit yet attached to the container by means of the same wires which afford retention of the two parts when separated from the container.

It is an advantage of the present invention to provide an improved hinging cover arrangement for a container.

Another advantage is a two-part lid construction for a container which allows the lid to be removed from the container as a single and immobile unit.

It is yet another advantage of this invention to provide a lid construction of the foregoing type which when separated has the lid portions locked as a unit yet when pivotally attached to the container allows both portions of the lid to pivot in a separate manner.

It is still another advantage of this invention to provide a lid assembly of the foregoing type wherein the same wire arrangement which affords positive engagement with the lids to hold them in a locked manner when separated from the container also affords a locking hinging arrangement for the lid portions when connected to the container.

Other advantages of this invention are a nestable and stackable container of the foregoing type which is composed of minimum number of parts, lends itself to a durable construction yet is easily used and manufactured.

SUMMARY OF THE INVENTION

The foregoing advantages are accomplished and the shortcomings of the prior art are overcome by the present detachable two-part lid for a container wherein the parts of the lid are held together as a locked unit when removed from the container yet are hinged separately when attached to the container. The container has hinge posts extending from an upper portion thereof with an opening therein. A two component lid is provided with a combined hinge and retention member as represented by two wire members having opposing ends slidably connected to the lid for positioning the ends in the openings in the hinge posts. Means are operatively positioned in connection with the lid to hold the wires in a first position so that the two components of the lid are held together as a unit. There are also means constructed and arranged with respect to the wire members and the lid to retain the cover on the container when the wire is moved from a lid locking first position to a second position where the wire ends engage the openings in the hinge posts and the lid components are hinged to the container.

In a preferred emodiment, the detachable two-part lid is defined by two wire members of a substantially U-shape. They are oppositely positioned in the two component lid with each having two opposing ends for positioning in the openings in said hinge posts.

Also in a preferred manner, the means constructed and arranged with respect to the wire member and the lid to retain the lid and the wire on the container when the wire is moved from the first position to the second position where the wire ends engage the openings includes a slotted guide member on the container and a curved portion in the wire. Preferably the curved portion is provided by a gooseneck-like section.

In still another preferred manner the wire has an offset portion for positioning in an overhang portion of the container or the lid, and the means to hold the wire in the first position so that the two components are held together as a unit is defined in part by a hinged latch means.

BRIEF DESCRIPTION OF THE DRAWINGS

A better understanding of the present detachable and attachable lid construction for a container will be accomplished with reference to the drawings wherein;

FIG. 1 is a top perspective view of the detachable lid container of this invention;

FIG. 3 is a partial and enlarged view showing a latching arrangement of a lid portion with a hinge wire;

FIG. 4 is a view taken along line 4—4 of FIG. 3;

FIG. 5 is a view taken along line 5—5 of FIG. 3;

FIG. 6 is a partial enlarged view showing the hinge wire in one stage of operation;

FIG. 7 is a view taken along line 7—7 of FIG. 6;

FIG. 8 is a partial view in cross section illustrating the engagement of the ends of the hinge wires with the openings in the hinge posts of the container;

FIG. 9 is a partial view of an alternative embodiment;

FIG. 10 is a view taken along line 10—10 of FIG. 9; and

DESCRIPTION OF THE PREFERRED EMBODIMENT

Figure 2:
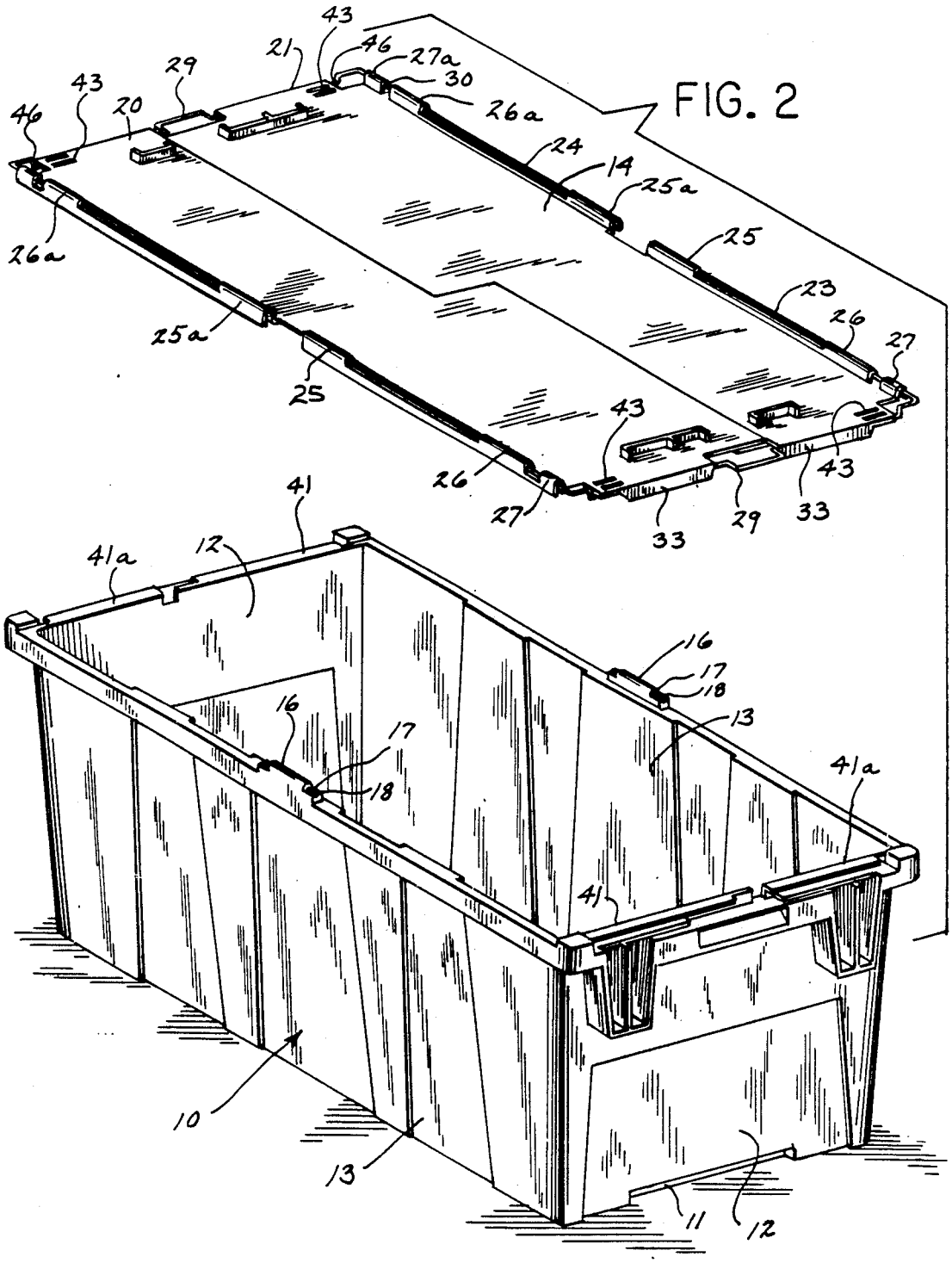
FIG. 2 is an assembly view in perspective showing a latching detachable lid container of FIG. 1.

Proceeding to detailed description of the present invention and particularly FIGS. 1 and 2, the container 10 generally includes a bottom portion 11 with end walls 12 and side walls 13. A lid member 14 has overlapping lid portions 20 and 21 for covering the top of the container when it is in the closed position as shown in FIG. 1. As best seen in FIGS. 2 and 8, the container 10 includes centrally located hinge posts 16 having openings 17 and guide slots 18 for purposes which will be explained later in conjunction with attaching the lid member 14 to the container 10. The lid portions 20 and 21 have slidably disposed therein two oppositely positioned U-shaped wires 23 and 24. These are slidably guided through pairs of guides 25, 25a, 26, 26a, 27 and 27a.

As best seen in FIGS. 6 and 7, the guide wire 23 includes a curved or gooseneck portion 30 which in one position is disposed in the slot 31 of the guides 27 and 27a. Each wire 23 and 24 has two of the gooseneck portions 30 each for slidable engagement in the slots 31 of the guides 27 and 27a. Each of the wires 23 and 24 has offset portions 45 and 46 for fitting into the cover overhang 33 in one position and in the container overhang 41 and 41a in another.

Referring to FIGS. 3–5, there is a latch member 32 pivotally attached to the lid portion 20. This attachment is afforded by a hinge 37. The latch 32 includes an inclined portion 35 as part of a wire engagement section 39. It extends through an opening 34 in the lid portion 20. A finger pressure section 38 is provided on the latch member 32 for purposes of pivoting it as indicated in the broken line showing in FIG. 5. Although not shown, a similar latch member is attached to lid portion 21 at the opposite end of the lid 14. As also shown in FIG. 3, the lid portion 20 includes an undercut 33 for receiving the offset portion 45 of the wire 23 between the latch 32 and the undercut 33. Two such undercuts 33 are disposed at opposite ends of the lid portions 20 and 21.

As illustrated in FIGS. 9 and 10, there is an alternative latching mechanism for the wire 23. This is afforded by a hinged bar 43 which is of a one piece construction with the cover member 14 but is separated by the slots 36. It has a wire engaging portion 44 for contact with the offset portion 45 of the wire 23 and for retaining it in the lid overhang portion 33.

A better understanding of the detachable lid container will be had by the following description of its operation.

OPERATION

The container 10 and removable lid member 14 of this invention is further described in conjunction with its operation. The container 10 will in normal use during shipping be in the condition indicated in FIG. 1. This will be with the lid portions 20 and 21 hingedly attached to the container 10. In order to attach the lid portions 20 and 21 to the container 10, the lid 14 is positioned as indicated in FIG. 2 with respect to the container 10. In this position it is seen that the U-shaped wires 23 and 24 are extended to their most outward position with respect to the lid portions 20 and 21. As best seen in FIGS. 6 and 7, the gooseneck portions 30 of the U-shaped wires 23 and 24 are positioned in the slots 31 of the guides 27 and 27a. At the same time the offset portion 45 of the wire 23 will be captured between the engaging portion 44 of the hinge bar 43 and in the overhang 33 of the lid portions 20 and 21. Specific reference is made to FIGS. 9 and 10 in this respect. As the wires 23 and 24 extend beneath both lid portions 20 and 21 in the indicated manner, they hold the lid portions 20 and 21 in a locked and unitary manner.

When it is desired to position the lid 14 on the container 10 the lid 14 will be placed with respect to the container in the manner indicated in FIG. 1. In this manner the guides 25 and 25a are aligned immediately adjacent to the hinge posts 16, and an inward movement is imparted to the hinge wires 23 and 24 to move the ends of the wires into the openings 17 of the hinge posts 16. When this is done, the gooseneck portions 30 are moved from within the slots 31 of the guides 27 and 27a to a position between the guides 27 and 26 as indicated in broken lines in FIG. 7. Simultaneously, the offset portion 45 of the wire 23 will move from the cover overhangs 33, underneath the engaging portion 44 of the hinged bar 43 and into the bottom overhangs 41 and 41a of the container 10. It will be appreciated that at the same time or subsequent thereto the same positioning can occur with respect to the hinge wire 24. In this position, the two lid portions 20 and 21 become hinged to the container 10. They are now free to be raised upwardly in the usual manner.

Figure 11:
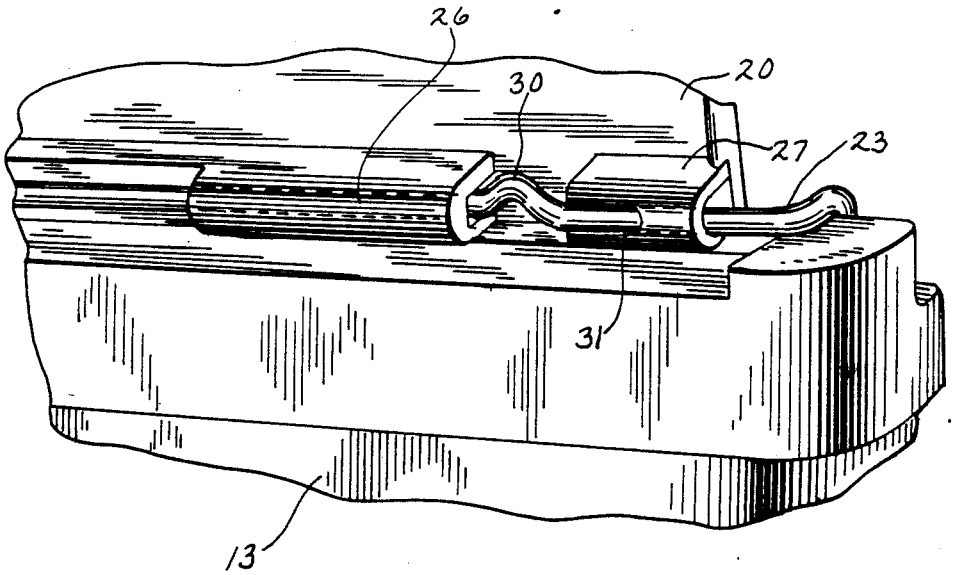
FIG. 11 is an enlarged partial view illustrating the hinge wire retention feature of this invention.

Not only can the lid portions be raised and lowered in the usual manner, it will be appreciated that once the lid portions 20 and 21 are raised upwardly from the container 10, the U-shaped wires 23 and 24 cannot be removed from the lid portions 20 and 21 as the goosenecks 30 are trapped between the guides 27 and 26. This is best illustrated in FIG. 11. It is not until the lid portions 20 and 21 are placed back to their horizontal positions on the container 10 that the wires 23 and 24 can be retracted from the openings 17 in the hinge post 16 with the goosenecks 30 back in the slots 31 and in their original positions. It should be pointed out that with the U-shaped wires 23 and 24 free of the overhangs 33 in the lid portions 20 and 21 they are securely held on the container 10 not only with the engagement in the hinge openings 17 but also with the offset portion 45 placed in the overhangs 41 and 41a of the container 10. In a similar manner, the offset portion 46 of the wire 24 engages similar overhangs 41 and 41a at the opposing end of the container 10.

It will be further recognized that with a close positioning of the guides 25 and 25a with respect to the hinge posts 16, lateral movement of the lid portions 20 and 21 is restricted when placed on the container 10. This also adds to the stability of the container system.

The operation of the latch 32 acts in a similar manner as do the latching hinged bars 43. The purpose being to capture the offset portions 45 and 46 between the engaging section 39 and the undercuts 33 at opposite ends of the lid 14. The offset portions 45 and 46 are automatically captured as they move under the engagement section 39 due to the inclined portion 35. Once captured between the engagement section 39 and the undercuts 33 release can be effected by exerting a force on the pressure point 38 which will raise the engagement section 39 as indicated by the broken line showing of the latch 32 in FIG. 5.

In the preferred embodiment, slots 31 are indicated in the guides 27 and 27a for receiving the gooseneck portions 30 of the wires 23 and 24. While this is a partial slot, it will be appreciated that the same function of the wire retention feature with respect to the guides 27 and 27a can be effected with a complete slot. However, a complete slot through the guide will not provide as stable a guide. Also, it will be appreciated that the wire retention feature can be accomplished without the container overhangs 41 and 41a being employed. However these afford a more stable construction. Further, while the handle sections such as 29 are indicated for the U-shaped hinge wires 23 and 24, these can be eliminated. Also, while guide slots 18 are indicated for guiding the ends of the hinge wires 23 and 24 into the hinge post openings 17, these also could be eliminated. Offset portions 45 and 46 are utilized in conjunction with capturing the U-shaped wires 23 and 24 either onto the container 10 or onto the lid portions 20 and 21. Obviously, a straight wire section could also be employed and still utilize the gooseneck retention feature during hinging of the lid portions 20 and 21. However this would require a modification of the lid portions 20 and 21 to allow passage therethrough. Further, while two wire members 23 and 24 are illustrated for holding and hinging the lid portions, one wire member could be eliminated. Again, this would not operate as efficiently.

It will thus be seen that through the present invention there is now provided a hinging system for a container wherein the hinging wire serves to interconnect and lock two separate lid portions yet at the same time provides a hinging means for the lid portions. This results in a two-part lid which can be easily stored away from the container as well as easily handled. In addition, the wires are designed in conjunction with the covers so that they are not easily removed from the container when the lids are being opened. The lid portions can be attached to and removed from the container with a minimum amount of effort and manipulation on the part of the operator. No secondary fastening systems need be employed in order to attach the hinge wires to the container or to prevent them from being removed once they are placed in operation. The hinging system herein described can be easily fabricated with minor modifications to molding as well as in the design of the wire hangers.

While only certain preferred features of the invention have been shown by way of illustration, many modifications and changes will occur to those skilled in the art. It is therefore, to be understood that the appended claims are intended to cover all of its modifications and changes as fall within the true spirit of the invention.

We claim:

1. A detachable two-part lid for a container wherein the parts of the lid are held together as a unit when removed from the container yet are hinged separately when attached to the container comprising:

a container having hinge posts extending from an upper portion thereof with an opening in said hinge posts;

a two component lid;

a combined hinge and retention member having opposing ends slidably connected to said lid for positioning said ends in said openings in said hinge posts;

means operatively positioned in connection with said lid to hold said combined hinge and retention member in a first position so that said two components of said lid are held together as a unit; and means constructed and arranged with respect to said combined hinge and retention member and said lid to retain said cover on said container when said combined hinge and retention member is moved from said first position to a second position where said ends engage said opening in said hinge posts and said lid components are hinged to said container.

2. The detachable two-part lid as defined in claim 1 wherein said combined hinge and retention member is a wire member.

3. The detachable two-part lid as defined in claim 2 wherein there are two wire members of a substantially U-shape oppositely positioned in said two component lid each having two opposing ends for positioning in said openings in said hinge posts.

4. The detachable two-part lid as defined in claim 3 wherein said means constructed and arranged with respect to said wire member and said lid to retain said lid on said container when said wire is moved from said first position to said second position where said wire ends engage said openings in said hinge posts includes a slotted member and a curved portion in said wire.

5. The detachable two-part lid as defined in claim 4 wherein said curved portion in said wire is provided by a gooseneck-like section.

6. The detachable two-part lid as defined in claim 5 wherein said means constructed and arranged with respect to said wire member and said lid to retain said lid on said container when said wire is moved from said first to said second position includes an overhang portion in said container.

7. The detachable two-part lid as defined in claim 6 wherein said wire has an offset portion for positioning in said overhang portion.

8. The detachable two-part lid as defined in claim 7 wherein said offset portion includes a handle section.

9. The detachable two-part lid as defined in claim 3 wherein said means to hold said wire in said first position so that said two components are held together as a unit is defined in part by a hinged latch means.

10. The detachable two-part lid as defined in claim 9 wherein said latch means is defined by a pivotal latch member.

11. The detachable two-part lid as defined in claim 10 wherein said latch member includes an actuated pressure point at one end and a wire engaging section at the other having an inclined portion.

12. The detachable two-part lid as defined in claim 10 wherein said pivotal latch member is defined by a hinged bar member having a wire engaging portion.

* * * * *